US007252354B2

(12) United States Patent
Ito et al.

(10) Patent No.: US 7,252,354 B2
(45) Date of Patent: Aug. 7, 2007

(54) LIQUID EJECTING HEAD DRIVE METHOD AND LIQUID EJECTION DEVICE

(75) Inventors: Maki Ito, Nagano-ken (JP); Masami Murai, Nagano-ken (JP); Shiro Yazaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

(21) Appl. No.: 10/488,747

(22) PCT Filed: Sep. 11, 2002

(86) PCT No.: PCT/JP02/09287

§ 371 (c)(1),
(2), (4) Date: Sep. 30, 2004

(87) PCT Pub. No.: WO03/022582

PCT Pub. Date: Mar. 20, 2003

(65) Prior Publication Data

US 2005/0052482 A1 Mar. 10, 2005

(30) Foreign Application Priority Data

| | | |
|---|---|---|
| Sep. 11, 2001 | (JP) | 2001-275725 |
| Oct. 12, 2001 | (JP) | 2001-316013 |
| Jun. 24, 2002 | (JP) | 2002-183515 |
| Aug. 5, 2002 | (JP) | 2002-227841 |

(51) Int. Cl.
*B41J 29/38* (2006.01)
*B41J 2/045* (2006.01)

(52) U.S. Cl. ..... 347/10; 347/68

(58) Field of Classification Search ..... 347/10–11, 347/68–72, 12
See application file for complete search history.

(56) References Cited

U.S. PATENT DOCUMENTS

| | | | | |
|---|---|---|---|---|
| 4,714,935 | A * | 12/1987 | Yamamoto et al. | 347/10 |
| 6,290,315 | B1 * | 9/2001 | Sayama | 347/10 |
| 6,371,587 | B1 * | 4/2002 | Chang | 347/11 |
| 6,478,395 | B2 * | 11/2002 | Tanaka et al. | 347/11 |
| 6,848,763 | B2 * | 2/2005 | Sumi | 347/10 |
| 2002/0005879 | A1 * | 1/2002 | Kitahara | 347/68 |

FOREIGN PATENT DOCUMENTS

| | | |
|---|---|---|
| JP | 62-057265 A | 3/1987 |
| JP | 02-194575 A | 8/1990 |
| JP | 02-201977 A | 8/1990 |

(Continued)

*Primary Examiner*—Matthew Luu
*Assistant Examiner*—Lisa M. Solomon
(74) *Attorney, Agent, or Firm*—Sughrue Mion, PLLC

(57) ABSTRACT

A liquid-ejecting apparatus according to which targeted good characteristics can be obtained, and moreover the scope for material selection can be broadened is provided. The liquid-ejecting apparatus contracts a pressure chamber and thus ejects liquid through application of voltage to a piezoelectric body, and is such that the driving waveform applied to the piezoelectric body during the liquid ejecting operation comprises a high potential period (a2) in which a voltage exhibiting an electric field strength exceeding the coercive electric field of the piezoelectric body is applied, and a reverse potential period (a6) in which a voltage such that the potential becomes of the opposite polarity to the polarity in the high potential period or the potential becomes zero is applied.

7 Claims, 13 Drawing Sheets

FOREIGN PATENT DOCUMENTS

| | | | |
|---|---|---|---|
| JP | 05-145133 | A | 6/1993 |
| JP | 05-286131 | A | 11/1993 |
| JP | 07-227964 | A | 8/1995 |
| JP | 09-141866 | A | 6/1997 |
| JP | 10-166579 | A | 6/1998 |
| JP | 10-261822 | A | 9/1998 |
| JP | 11-097755 | A | 4/1999 |
| JP | 11-268266 | A | 10/1999 |
| JP | 2000-158651 | A | 6/2000 |
| JP | 2001-105592 | A | 4/2001 |
| JP | 2001-162793 | A | 6/2001 |

* cited by examiner

1: INK JET RECORDING HEAD

LIQUID EJECTING HEAD DRIVE METHOD AND LIQUID EJECTION DEVICE

TECHNICAL FIELD

The present invention relates to a liquid-ejecting apparatus that ejects liquid such as ink through control of the voltage applied to piezoelectric elements, and in particular to a liquid-ejecting apparatus such as a printer that applies a waveform that enables the piezoelectric characteristics of the piezoelectric elements to be exhibited to the full during a printing operation. Moreover, the present invention relates to a liquid-ejecting head driving method in which such a waveform is applied.

BACKGROUND ART

An ink jet recording head comprises pressure chambers that generate ink pressure using piezoelectric elements or heat-generating elements, an ink chamber that supplies ink to the pressure chambers, and nozzles that eject ink from the pressure chambers. The pressure is generated by applying driving signals to the elements in accordance with printing signals, whereby ink drops are made to fly out from the nozzles onto a recording medium. In particular, with an ink jet recording head that uses piezoelectric elements, heat is not used, and hence there are advantages such as degradation of the ink being not prone to occurring, and clogging being not prone to occurring.

With such an ink jet recording head that uses piezoelectric elements, with an aim of improving the ink ejecting characteristics given by the piezoelectric films, efforts have been made to obtain good characteristics by making the piezoelectric films have a particular composition, crystal orientation or the like. For example, the inventors have discovered that PZT having a 100 plane orientation degree of 70% or more exhibits good characteristics.

However, it is not easy to manufacture piezoelectric films having a particular crystal orientation or the like. Moreover, if the crystal orientation or the like is limited to being a particular one, then the flexibility of material selection is narrowed. Consequently, if it were possible to obtain targeted good characteristics even with, for example, PZT having a 100 plane orientation degree of less than 70%, then the effects of this would be great.

It is thus an object of the present invention to provide a liquid-ejecting apparatus according to which targeted good characteristics can be obtained, and moreover the scope for material selection can be broadened.

DISCLOSURE OF THE INVENTION

A liquid-ejecting apparatus according to the present invention is a liquid-ejecting apparatus that contracts a pressure chamber and thus ejects liquid through application of voltage to a piezoelectric body, and is such that a driving waveform applied to the piezoelectric body during the liquid ejecting operation comprises a high potential period in which a voltage exhibiting an electric field strength exceeding the coercive electric field of the piezoelectric body is applied, and a reverse potential period in which a voltage such that the potential becomes of the opposite polarity to the polarity in the high potential period or the potential becomes zero is applied. As a result, the characteristics of the piezoelectric body can be better exhibited.

In the liquid-ejecting apparatus described above, it is preferable for the voltage applied in the reverse potential period to be a voltage exhibiting an electric field strength that does not exceed the coercive electric field of the piezoelectric body. As a result, the characteristics of the piezoelectric body can be exhibited to the full.

In the liquid-ejecting apparatus described above, the voltage applied in the reverse potential period may be a voltage exhibiting an electric field strength of at least the coercive electric field of the piezoelectric body. As a result, residual polarization in the piezoelectric body can be controlled. In this liquid-ejecting apparatus, it is preferable for the voltage applied in the reverse potential period to be a voltage that eliminates residual polarization of the piezoelectric body. Moreover, after the pressure chamber has expanded in the reverse potential period, when contraction of the pressure chamber has started, it is preferable for the pressure chamber to be further contracted to eject the liquid through the high potential period while the pressure chamber has not yet expanded again. As a result, the contraction of the pressure chamber due to the coercive electric field being exceeded and the contraction of the pressure chamber due to moving into the high potential period can be synchronized, and hence the displacement amount and the displacement velocity can be increased. Moreover, it is preferable for the time period for which the voltage exhibiting an electric field strength of at least the coercive electric field is applied to be not more than 2 μs out of the reverse potential period. As a result, the meniscus can be prevented from becoming unstable, and moreover a larger displacement can be obtained. Moreover, it is preferable for the time period between when the absolute value of the voltage applied in the reverse potential period starts to drop from a maximum value and when the absolute value of the voltage applied in the high potential period reaches approximately a maximum to be not more than 2 μs. As a result, the displacement amount and the displacement velocity can be increased effectively.

In the liquid-ejecting apparatus described above, it is preferable for the absolute value of the voltage applied in the reverse potential period to be not more than the absolute value of the maximum voltage in the high potential period.

In the liquid-ejecting apparatus described above, it is preferable for the voltage to be applied to a piezoelectric thin film. In particular, it is preferable for a voltage exhibiting an electric field strength of at least $1.5\times10^7$ V/m to be applied in the high potential period. Moreover, it is preferable for the voltage to be applied at a frequency of at least 20 kHz.

In the liquid-ejecting apparatus described above, it is preferable for the driving waveform to have one of the reverse potential period per one of the high potential period.

In the liquid-ejecting apparatus described above, it is preferable for a portion, out of the driving waveform applied during the liquid ejecting operation, corresponding to during a contraction operation of the pressure chamber to contain at least part of the high potential period, and at least part of the reverse potential period. As a result, a large displacement can be used in contracting the pressure chamber.

Moreover, in the liquid-ejecting apparatus described above, it is preferable for the strain in the piezoelectric body during liquid ejection by the liquid-ejecting head to be at least 0.3%.

In the liquid-ejecting apparatus described above, it is preferable for the driving waveform to be constituted such that the pressure chamber is contracted and hence liquid is ejected through a change in the potential from a prescribed medium potential to the maximum potential in the high potential period, and the potential returns to the prescribed medium potential via the reverse potential period, and moreover for the change in the potential from the reverse potential period to the prescribed medium potential to be made to have a gradient such that liquid is not ejected.

In the liquid-ejecting apparatus described above, it is preferable for the potential to be changed continuously from the maximum potential in the high potential period to the potential in the reverse potential period. As a result, driving at high frequency can be made possible.

In the liquid-ejecting apparatus described above, it may be made to be such that the voltage of the reverse potential period can be applied selectively per one application of the voltage of the high potential period. As a result, the size of the liquid drops can be varied.

A driving method of the present invention is a liquid-ejecting head driving method in which a pressure chamber is contracted and thus liquid is ejected through application of voltage to a piezoelectric body, and is such that a driving waveform applied to the piezoelectric body during a printing operation comprises a high potential period in which a voltage exhibiting an electric field strength exceeding the coercive electric field of the piezoelectric body is applied, and a reverse potential period in which a voltage such that the potential becomes of the opposite polarity to the polarity in the high potential period or the potential becomes zero is applied.

BRIEF DESCRIPTION OF THE DRAWINGS

Regarding FIG. 10.

Figure 1:
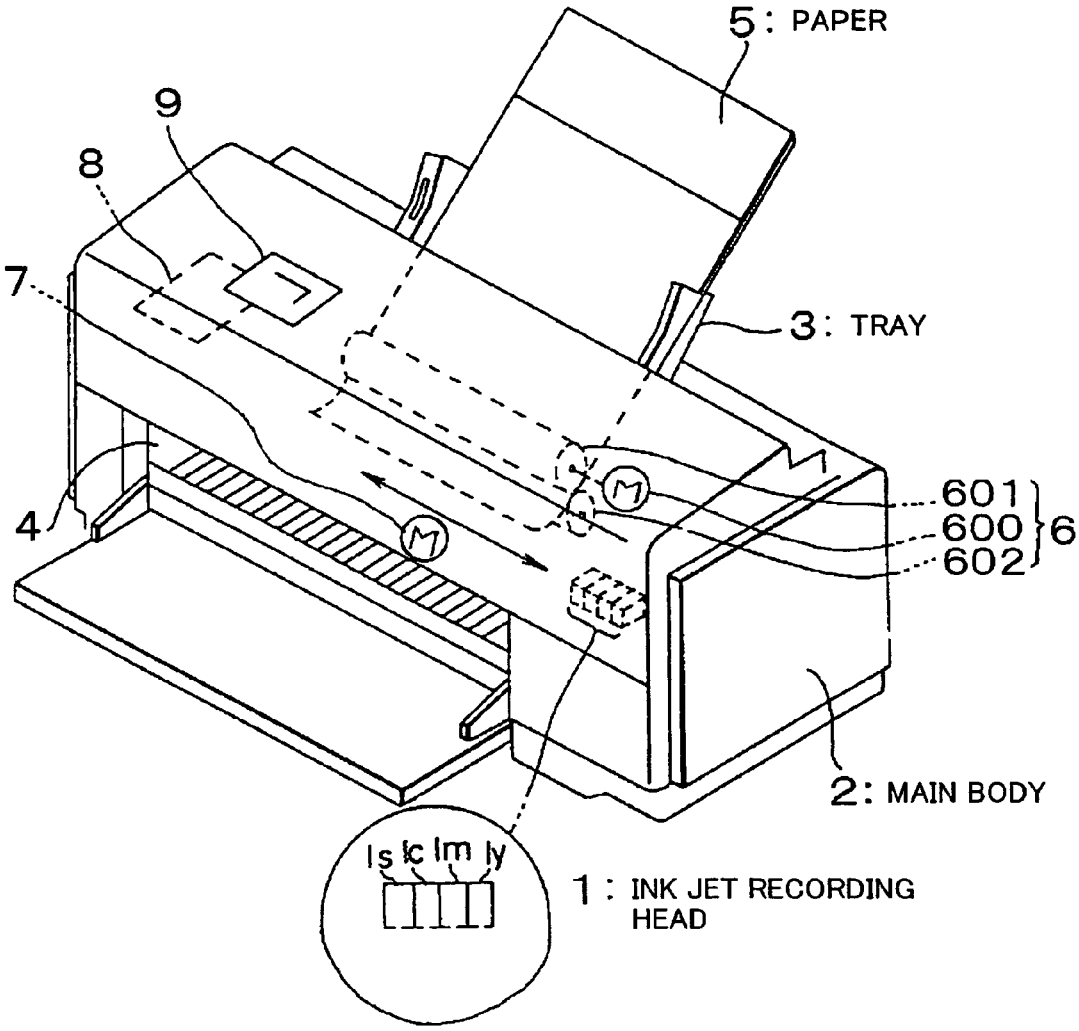
FIG. 1 is a perspective view for explaining the structure of a printer, which is a liquid-ejecting apparatus according to an embodiment of the present invention.

Note that in the drawings, 10 is a nozzle plate, 20 is a pressure chamber substrate, 30 is a diaphragm, 31 is an insulating film, 32 is a bottom electrode, 40 is a piezoelectric element, 41 is a piezoelectric thin-film layer, 42 is an top electrode, and 21 is a pressure chamber.

BEST MODE FOR CARRYING OUT THE INVENTION

Following is a description of embodiments of the present invention, with reference to the drawings.

<1. Overall Constitution of Ink Jet Printer>

FIG. 1 is a perspective view for explaining the structure of a printer, which is a liquid-ejecting apparatus according to an embodiment of the present invention. In the printer, a tray 3, a discharge opening 4 and operation buttons 9 are provided on/in a main body 2. Furthermore, inside the main body 2 are provided an ink jet recording head 1, which is a liquid-ejecting head, a paper-feeding mechanism 6, and a control circuitry 8.

The ink jet recording head 1 has piezoelectric elements, which will be described later. The ink jet recording head 1 is constituted such that liquid such as ink can be ejected from nozzles in accordance with ejection signals supplied from the control circuitry 8.

The main body 2 is the casing of the printer; the paper-feeding mechanism 6 is disposed in a position so as to be able to feed in paper 5 from the tray 3, and the ink jet recording head 1 is disposed so as to be able to carry out printing on the paper 5. The tray 3 is constituted such that the paper 5 can be fed in to the paper-feeding mechanism 6 before printing, and the discharge opening 4 is an outlet from which the paper 5 is discharged after the printing has been completed.

The paper-feeding mechanism 6 comprises a motor 600, rollers 601 and 602, and other mechanical structure that is not shown in FIG. 1. The motor 600 is able to rotate in accordance with driving signals supplied from the control circuitry 8. The mechanical structure is constituted so as to be able to transmit the rotational power of the motor 600 to the rollers 601 and 602. The rollers 601 and 602 are such as to rotate upon the rotational power of the motor 600 being transmitted thereto, and through this rotation draw in paper 5 that has been loaded into the tray 3, and feed in the paper 5 so that printing can be carried out by the head 1.

The control circuitry 8 comprises a CPU, a ROM, a RAM, interface circuitry and so on, which are not shown in FIG. 1; the control circuitry 8 is such as to be able to supply driving signals to the paper-feeding mechanism 6 and ejection signals to the ink jet recording head 1, this being in accordance with printing data supplied from a computer via a connector, which is not shown in FIG. 1. Moreover, the control circuitry 8 is such as to be able to carry out operation mode setting, resetting and so on in accordance with operating signals from the operation panel 9.

<2. Electrical Constitution of Ink Jet Printer>

Figure 2:
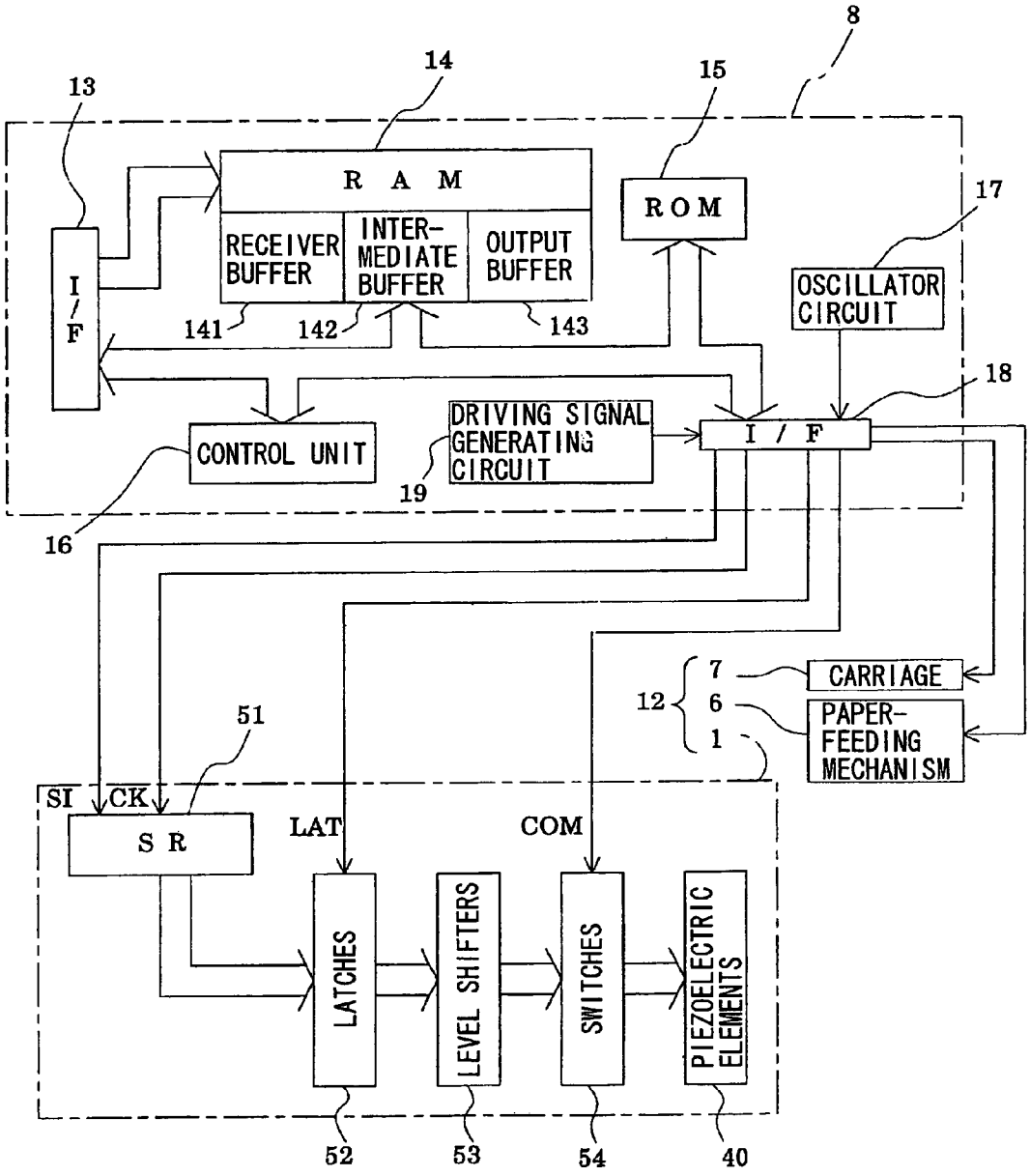
FIG. 2 is a block diagram showing the electrical constitution of the above-mentioned printer.

FIG. 2 is a block diagram showing the electrical constitution of the printer described above. As shown in FIG. 2, the electrical constitution of the printer in the present embodiment comprises the control circuitry 8 and a print engine 12.

The control circuitry 8 comprises an external interface 13 (hereinafter referred to as the 'external I/F 13'), a RAM 14 that stores various data temporarily, a ROM 15 that stores a control program and so on, a control unit 16 that contains a CPU and so on, an oscillator circuit 17 that generates clock signals, a driving signal generating circuit 19, which is driving means that generates driving signals to be supplied to the ink jet recording head 1, and an internal interface 18 (hereinafter referred to as the 'internal I/F 18') that sends to the print engine 12 the driving signals and dot pattern data (bit map data) that has been created through expansion based on the printing data.

The external I/F 13 receives, from a host computer or the like, which is not shown in the drawings, printing data that is constituted from, for example, character codes, graphics functions, image data, or the like. Moreover, busy signals (BUSY) and acknowledge signals (ACK) are outputted to the host computer or the like via the external I/F 13.

The RAM 14 functions as a receiver buffer 141, an intermediate buffer 142, an output buffer 143, and a working memory, which is not shown in FIG. 2. The receiver buffer 141 temporarily stores printing data that has been received by the external I/F 13, the intermediate buffer 142 stores intermediate code data that has been created through conversion by the control unit 16, and the output buffer 143 stores dot pattern data. This dot pattern data is constituted from printing data obtained by decoding (translating) gradation data.

Moreover, in addition to the control program (control routines), which is for carrying out various types of data processing, the ROM 15 also stores font data, graphics functions, and so on.

The control unit 16 reads out printing data from the receiver buffer 141, and also stores intermediate code data obtained by converting this printing data into the intermediate buffer 142. Moreover, the control unit 16 analyzes intermediate code data read out from the intermediate buffer 142, and referring to the font data, graphics functions and so on stored in the ROM 15, expands the intermediate code data into dot pattern data. The control unit 16 then carries out required embellishing processing, and then stores the dot pattern data that has been created through expansion into the output buffer 143.

When the dot pattern data corresponding to one line's worth for the ink jet recording head 1 has been obtained, this one line's worth of dot pattern data is outputted to the ink jet recording head 1 via the internal I/F 18. Moreover, once this one line's worth of dot pattern data has been outputted from the output buffer 143, the intermediate code data for which the expansion has been completed is deleted from the intermediate buffer 142, and then expansion processing is carried out on the next batch of intermediate code data.

The print engine 12 comprises the ink jet recording head 1, the paper-feeding mechanism 6, and a carriage mechanism 7.

The paper-feeding mechanism 6 is constituted from the paper-feeding motor, the paper-feeding rollers and so on, and progressively feeds through a printing recording medium such as recording paper in synchronization with the recording operation of the ink jet recording head 1. That is, the paper-feeding mechanism 6 moves the printing recording medium relatively in a secondary scanning direction.

The carriage mechanism 7 is constituted from a carriage main body on which the ink jet recording head 1 can be mounted, and a carriage driving unit that makes the carriage main body travel along a principal scanning direction. By making the carriage main body travel, the ink jet recording head 1 can be moved in the principal scanning direction. Note that for the carriage driving unit, any mechanism can be adopted so long as it is a mechanism that enables the carriage main body to be made to travel, for example a carriage driving unit that uses a timing belt can also be used.

The ink jet recording head 1 has a large number of nozzles along the secondary scanning direction, and ejects ink drops from the nozzles with a timing governed by the dot pattern data or the like.

<3. Constitution of Ink Jet Recording Head>

Figure 3:
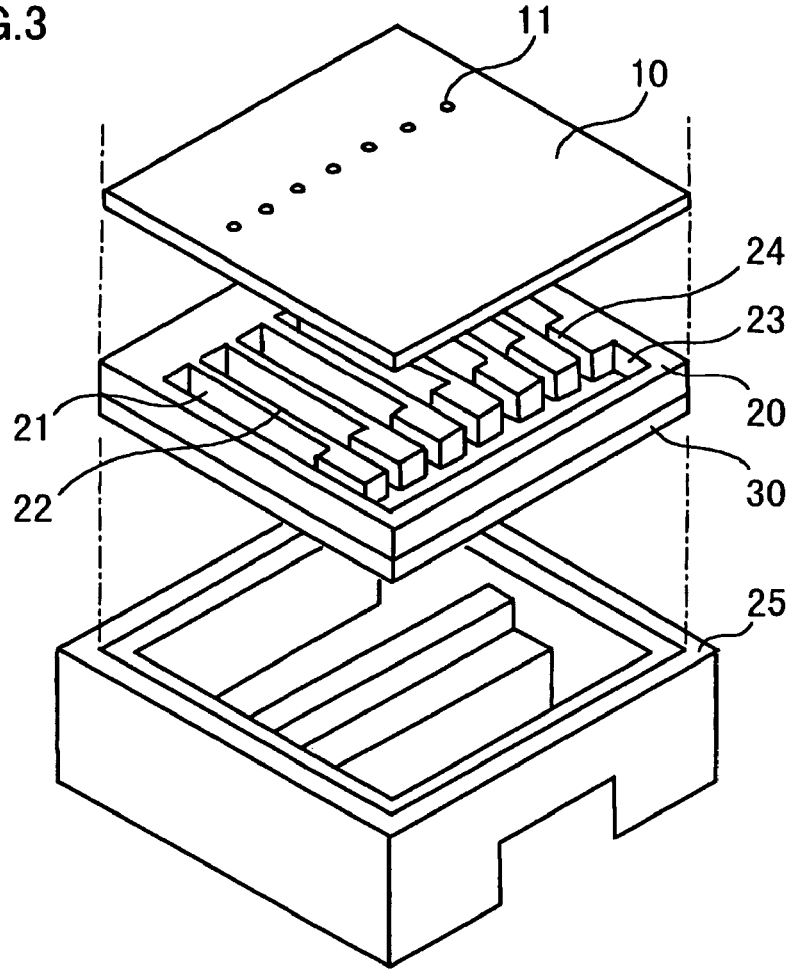
FIG. 3 is an explanatory view of the structure of an ink jet recording head used in the above-mentioned printer.

FIG. 3 is an explanatory view of the structure of the ink jet recording head used in the printer, or liquid-ejecting apparatus, described above. The ink jet recording head 1 is a so-called flexural oscillation ink jet recording head, and as shown in the FIG. 3, is constituted comprises a nozzle plate 10, a pressure chamber substrate 20, and a diaphragm 30. This head constitutes a piezo jet type head.

The pressure chamber substrate 20 comprises pressure chambers (cavities) 21, side walls (partitions) 22, a reservoir 23, and supply openings 24. The pressure chambers 21 are spaces for storing ink or the like for ejection and are formed by etching a substrate made of silicon or the like. The side walls 22 are formed so as to partition the pressure chambers 21 from one another. The reservoir 23 is a common channel for supplying ink to all of the pressure chambers 21. The supply openings 24 are formed so as to enable the ink to be introduced into the pressure chambers 21 from the reservoir 23.

The nozzle plate 10 is stuck onto one surface of the pressure chamber substrate 20 so that nozzles 11 in the nozzle plate 10 are disposed in positions corresponding respectively to the pressure chambers 21 provided in the pressure chamber substrate 20. The pressure chamber substrate 20 having the nozzle plate 10 stuck thereon is further put into a casing 25, thus constituting the ink jet recording head 1.

The diaphragm 30 is stuck onto the other surface of the pressure chamber substrate 20. Piezoelectric elements (not shown) are provided on the diaphragm 30. An ink tank connection port (not shown) is provided in the diaphragm 30, whereby ink stored in an ink tank, not shown, can be supplied to the reservoir 23 in the pressure chamber substrate 20.

<4. Layer Structure>

Figure 4:
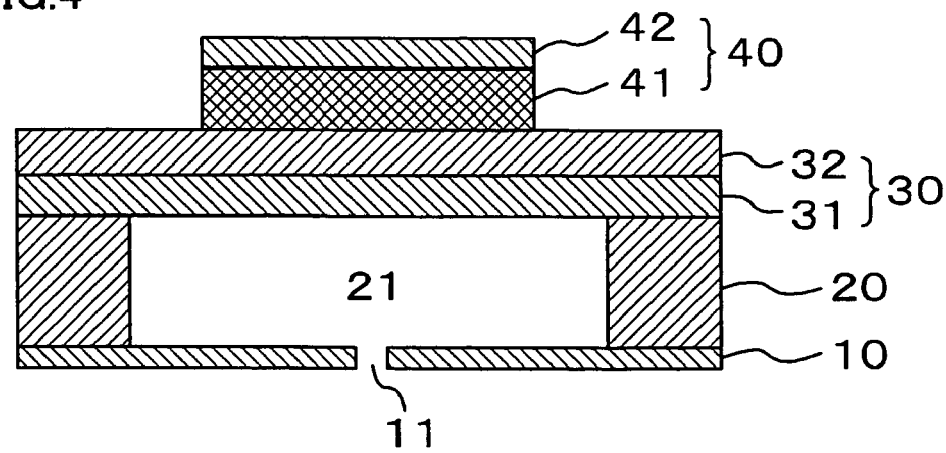
FIG. 4 is a sectional view for explaining the structure of the above-mentioned ink jet recording head in more detail.

FIG. 4 is a sectional view for explaining the structure of the ink jet recording head described above in more detail. This sectional view is an enlargement of a section through one pressure chamber and one piezoelectric element. As shown in FIG. 4, the diaphragm 30 is constituted from an insulating film 31 and a bottom electrode 32 laminated together, and the piezoelectric element 40 is constituted from a piezoelectric thin-film layer 41 and a top electrode 42 laminated on the bottom electrode 32. The ink jet recording head 1 is constituted such that the piezoelectric elements 40, the pressure chambers 21 and the nozzles 11 are provided in a line with a constant pitch. This inter-nozzle pitch can be subjected to design modification as required in accordance with the printing precision. For example, the nozzles may be provided at 400 dpi (dots per inch).

The insulating film 31 is formed to a thickness of approximately 1 μm from a material that is not electrically conductive, for example silicon dioxide ($SiO_2$), and is constituted so as to be able to deform upon deformation of the piezoelectric thin-film layer, whereby the pressure inside the pressure chamber 21 can be increased momentarily.

The bottom electrode 32 is one of the electrodes for applying a voltage to the piezoelectric thin-film layer, and is formed to a thickness of approximately 0.2 μm from a material that is electrically conductive, for example platinum (Pt) or the like. The bottom electrode 32 is formed in the same region as the insulating film 31 so as to function as a common electrode for the plurality of piezoelectric elements formed on the pressure chamber substrate 20. Note, however, that it is also possible to form bottom electrodes to the same size as the piezoelectric thin-film layers 41, i.e. in the same shape as the top electrodes.

Each top electrode 42 is the other electrode for applying a voltage to the corresponding piezoelectric thin-film layer, and is formed to a thickness of approximately 0.1 μm from a material that is electrically conductive, for example platinum (Pt) or iridium (Ir).

Each piezoelectric thin-film layer 41 comprises a crystal of a piezoelectric ceramic such as lead zirconate titanate (PZT) having a perovskite structure, and is formed on the diaphragm 30 in a prescribed shape. Each piezoelectric thin-film layer 41 is formed to a thickness of preferably not more than 2 μm, for example approximately 1 μm. The coercive electric field of such a piezoelectric thin film is, for example, approximately $2\times10^6$ V/m.

<5. Printing Operation>

A description will now be given of the printing operation for the ink jet recording head 1 having the constitution described above. Driving signals are outputted from the control circuitry 8, whereby the paper-feeding mechanism 6 operates and paper 5 is thus conveyed in to a position such that printing can be carried out by the head 1. If an ejection signal is not supplied from the control circuitry 8 and hence a voltage is not applied between the bottom electrode 32 and the top electrode 42 of a piezoelectric element 40, no deformation occurs in the piezoelectric thin-film layer 41. A pressure change thus does not occur in a pressure chamber 21 on which is provided a piezoelectric element 40 to which an ejection signal is not supplied, and hence an ink drop is not ejected from the nozzle 11 of that pressure chamber 21.

On the other hand, if an ejection signal is supplied from the control circuitry 8 and hence a certain voltage is applied between the bottom electrode 32 and the top electrode 42 of a piezoelectric element 40, deformation occurs in the piezoelectric thin-film layer 41. The diaphragm 30 flexes greatly at a pressure chamber 21 on which is provided a piezoelectric element 40 to which an ejection signal has been supplied. The pressure inside the pressure chamber 21 thus rises momentarily, and hence an ink drop is ejected from the nozzle 11. By individually supplying ejection signals to piezoelectric elements in positions in the head corresponding to the printing data, characters and graphics can be printed as desired.

<6. Electrical Constitution of Ink Jet Recording Head>

Next, a more detailed description will be given of the electrical constitution of the ink jet recording head described above, with reference to FIG. 5.

Figure 5:
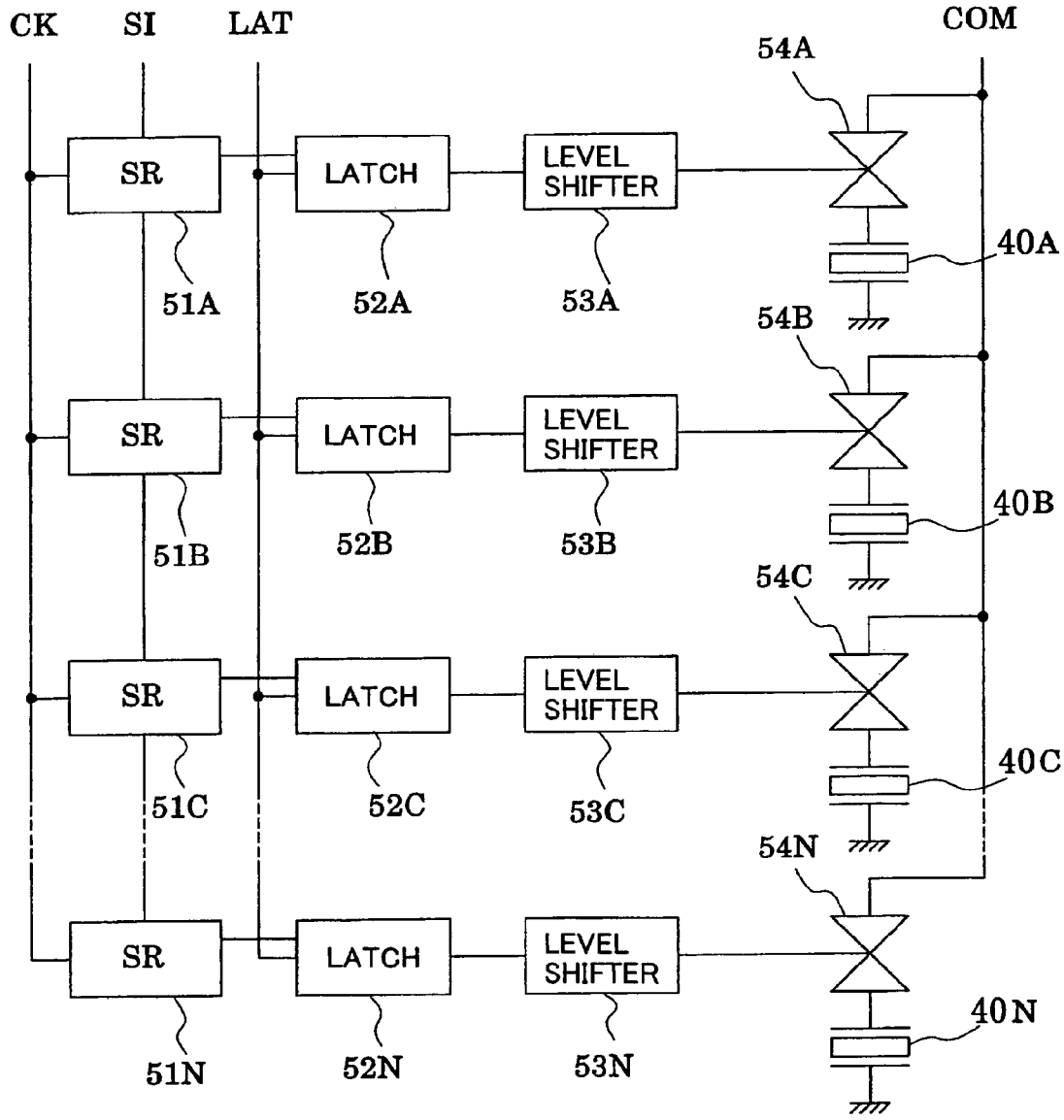
FIG. 5 is a diagram showing the electrical constitution of the above-mentioned ink jet recording head.

As shown in FIG. 5, the ink jet recording head 1 has shift registers 51, latch circuitry 52, level shifters 53, switches 54, the piezoelectric elements 40, and so on. Furthermore, as shown in FIG. 5, the shift registers 51, latch circuitry 52, level shifters 53, switches 54 and piezoelectric elements 40 are constituted respectively from shift register elements 51A to 51N, latch elements 52A to 52N, level shifter elements 53A to 53N, switch elements 54A to 54N, and piezoelectric elements 40A to 40N, which are provided for the respective nozzles 11 of the ink jet recording head 1. The shift registers 51, latch circuitry 52, level shifters 53, switches 54 and piezoelectric elements 40 are connected together electrically in this order.

The shift registers 51, latch circuitry 52, level shifters 53 and switches 54 produce driving pulses from ejection driving signals generated by the driving signal generating circuit 19. Here, the driving pulses are applied pulses that are actually applied to the piezoelectric elements 40.

Figure 6:
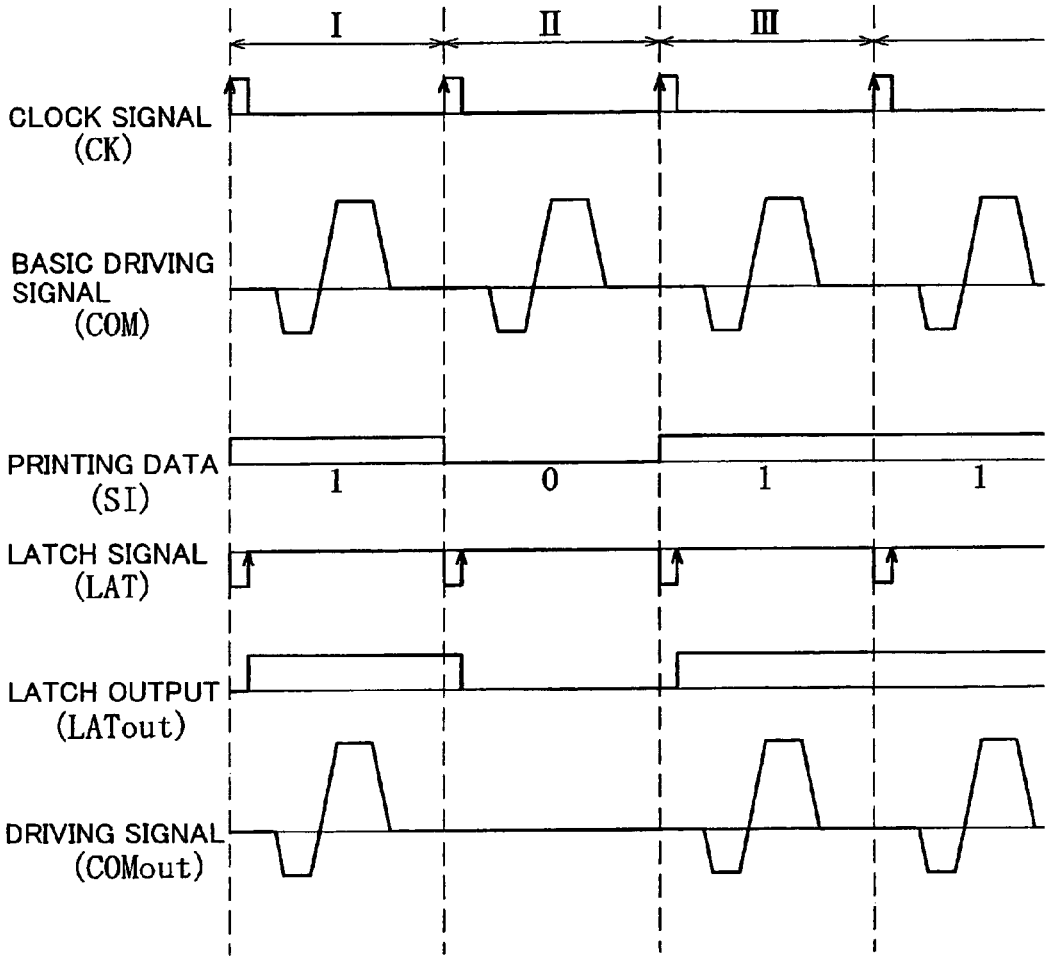
FIG. 6 is a diagram for explaining a procedure for applying driving pulses to a piezoelectric element appearing in FIG. 5.

FIG. 6 is a diagram for explaining the procedure for applying driving pulses (driving signals) to a piezoelectric element. A description will now be given of the control of the ink jet recording head 1 having an electrical constitution as described above, with reference to FIG. 6.

With the ink jet recording head 1 having an electrical constitution as described above, as shown in FIG. 6, initially, in synchronization with a clock signal (CK) from the oscillator circuit 17, printing data (SI) constituting dot pattern data is serially transferred from the output buffer 143 to the shift registers 51, and is set in order. If the data is set, first, the most significant bit data in the printing data for all of the nozzles 11 is serially transferred. Then, once the serial transfer of the most significant bit data has been completed, the second most significant bit data is serially transferred. Thereafter, the lower order bit data is similarly serially transferred in order.

Once the printing data for the bit in question has been set in the shift register elements 51A to 51N for all of the nozzles, the control unit 16 outputs a latch signal (LAT) to the latch circuitry 52 with a prescribed timing. Through this latch signal, the latch circuitry 52 latches the printing data that has been set in the shift registers 51. The printing data that has been latched by the latch circuitry 52 (LATout) is applied to the level shifters 53, which are voltage amplifiers. In the case that the printing data is, for example, '1', the level shifter 53 raises the voltage of the printing data up to a voltage value such that the switch 54 can be driven, for example a few tens of volts. The printing data for which the voltage has been raised is then applied to the switch elements 54A to 54N, and the switch elements 54A to 54N go into a connected state in accordance with the printing data.

Moreover, an ejection driving signal generated by the driving signal generating circuit 19 is also applied to each of the switch elements 54A to 54N. Consequently, if a switch element 54A to 54N is in a connected state, then the ejection driving signal is applied to the piezoelectric element 40A to 40N connected to that switch element 54A to 54N.

In this way, with the ink jet recording head 1 given as an example here, whether or not the ejection driving signal is applied to each of the piezoelectric elements 40 can be controlled through the printing data. For example, in a period in which the printing data is '1', the switch 54 goes into a connected state through the latch signal (LAT), and hence the driving signal (COMout) can be supplied to the piezoelectric element 40. The piezoelectric element 40 then undergoes displacement (deformation) due to the supplied driving signal (COMout). Moreover, in a period in which the printing data is '0', the switch 54 goes into an unconnected state, and hence supply of the driving signal to the piezoelectric element 40 is cut off. Note that in such a period in which the printing data is '0', the potential from immediately before is held for each of the piezoelectric elements 40, and hence the state of displacement from immediately before is maintained.

7. FIRST EXAMPLE AND COMPARATIVE EXAMPLE

Figure 7:
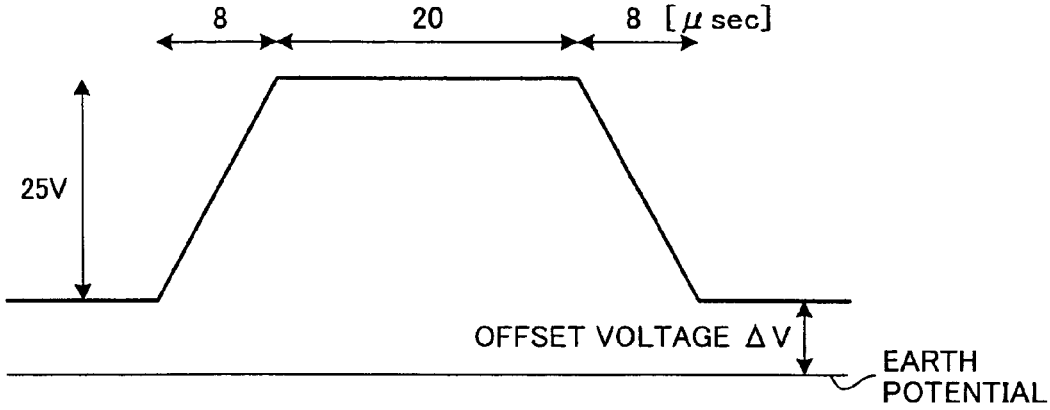
FIG. 7 is a waveform diagram of driving waveforms according to liquid-ejecting apparatuses and driving methods of a first example of the present invention and a comparative example.
Figure 8:
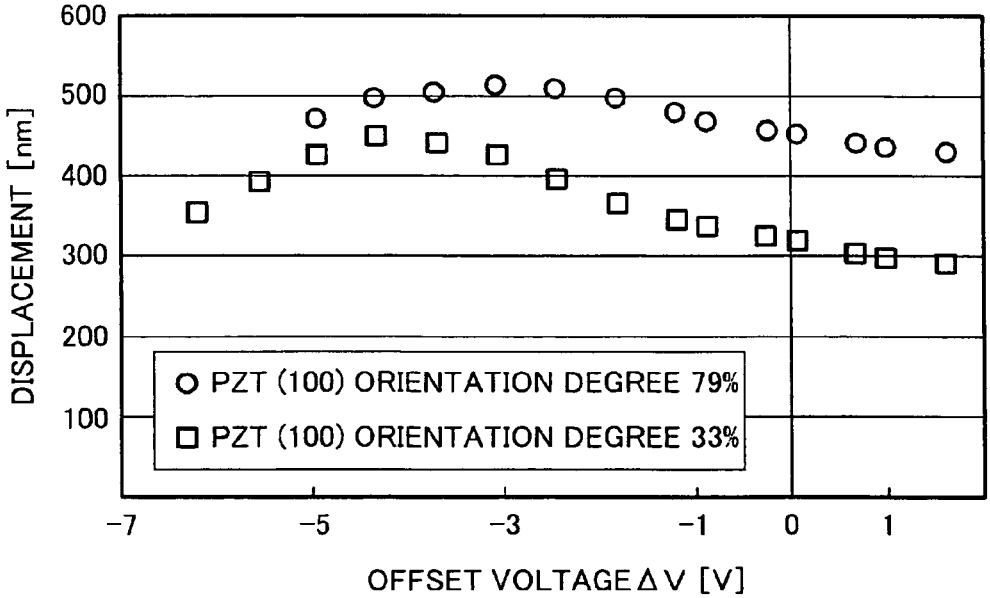
FIG. 8 is a graph showing results of measurements of displacement amount of a piezoelectric thin-film element using the driving waveforms of the first example and the comparative example.

FIG. 7 is a waveform diagram of driving waveforms according to liquid-ejecting apparatuses and driving methods of a first example of the present invention and a comparative example. FIG. 8 is a graph showing results of measurements of displacement amount of a piezoelectric thin-film element using these driving waveforms. As shown in FIG. 7, a trapezoidal wave that comprises an 8 μs potential rising period, a 20 μs maximum potential maintaining period, and an 8 μs potential falling period, and for which the difference between the minimum potential and the maximum potential is 25V, is used as the driving waveform. The offset voltage (the DC voltage between the minimum potential in the driving waveform and the earth potential) ΔV for this trapezoidal wave was variously changed, piezoelectric thin-film elements were driven, and the displacement amount was measured. The case that the offset voltage ΔV is less than zero corresponds to the first example in which there is a reverse potential period, and the case that the offset voltage ΔV is greater than or equal to zero corresponds to the comparative example in which there is no reverse potential period. As the piezoelectric thin-film elements, measurements were carried out for three samples using PZT having a (100) orientation degree of 79% (group 1), and three samples using PZT having a (100) orientation degree of 33% (group 2), and in each case the average was calculated.

In the case that the group 1 PZT was used, first, a displacement of approximately 420 nm to 450 nm was obtained for offset voltage $\Delta V \geqq 0$, which corresponds to the comparative example. If such a displacement amount is obtained, then use as an ink jet recording head is possible, but it is preferable for the displacement amount to be higher. Next, when measurements were carried out with offset voltage $\Delta V<0$, which corresponds to the first example, the displacement amount rose, with a maximum displacement of 513 nm being obtained around $\Delta V=-3V$.

In the case that the group 2 PZT was used, first, the displacement was approximately 290 nm to 315 nm for offset voltage $\Delta V \geqq 0$, which corresponds to the comparative example. This displacement amount is not really sufficient compared with group 1, and it is preferable for the displacement amount to be higher. Next, when measurements were carried out with offset voltage $\Delta V<0$, which corresponds to the first example, the displacement amount greatly rose, with a maximum displacement of 451 nm being obtained around $\Delta V=-4.3V$.

Note that for both group 1 and group 2, when the offset voltage ΔV was made yet lower (i.e. the absolute value made higher), the displacement amount dropped. It is presumed that this is because if the offset voltage ΔV is too low then the coercive electric field is exceeded, and hence the flexion inverts.

Figure 9A:
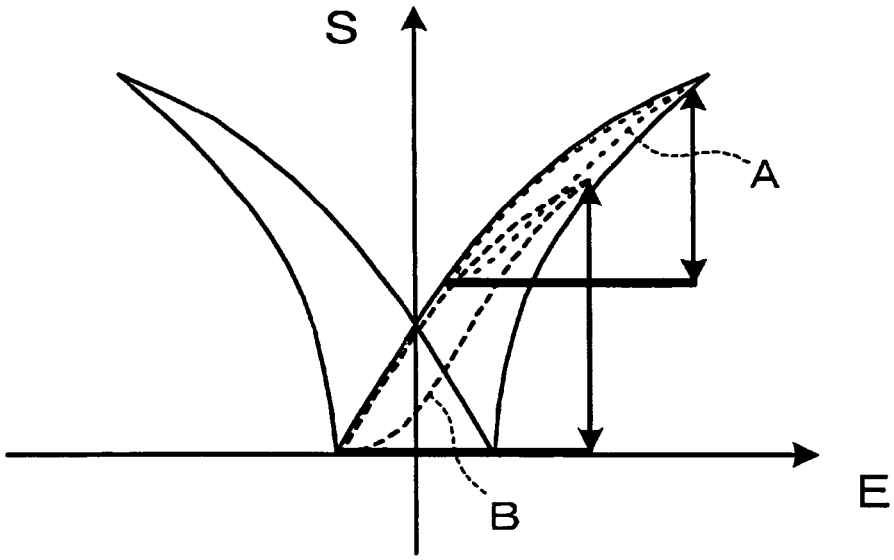
FIGS. 9A-9B are graphs showing characteristics of strain (S) versus electric field strength (E) for a piezoelectric thin film.

As described above, for both group 1 and group 2, by using the liquid-ejecting apparatus of the first example, the displacement amount increased compared with the comparative example. This increase in the displacement amount is explained through the hysteresis curve in FIG. 9A. As shown in FIG. 9A, with the driving of the comparative example in which there is no reverse potential period, the curve becomes as shown by the broken line A, and with the driving of the first example in which there is a reverse potential period, the curve becomes as shown by the broken line B. It can be seen that with the same amount of change in the electric field strength (E), a larger strain (S) is obtained with the broken line B.

Furthermore, even with piezoelectric elements such as group 2 for which it may be considered that sufficient characteristics cannot be obtained in the case of the comparative example, by using the liquid-ejecting apparatus of the first example, the displacement amount increases markedly, and characteristics sufficient for use can be obtained; the scope for material selection thus increases.

Figure 9B:
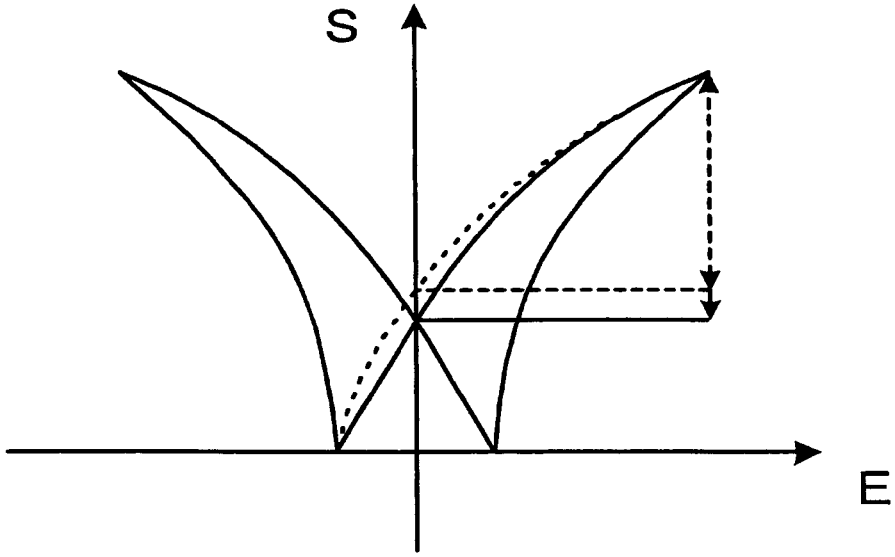

Moreover, in the case that driving was carried out using the liquid-ejecting apparatus according to the comparative example, upon carrying out driving a large number of times, i.e. for 100 million pulses or more, the displacement amount dropped by approximately 12% compared with the initial displacement amount, but in the case that driving was carried out using the liquid-ejecting apparatus according to the first example, it was found that the drop in the displacement was kept down to not more than 5% upon carrying out driving a large number of times. It is presumed that the reason for this is as follows. In the case that driving is carried out with an electric field higher than the coercive electric field of the piezoelectric body, if driving is carried out a large number of times, then the hysteresis curve changes to like the broken line shown in FIG. 9B. As a result, a drop in the displacement occurs with driving in which there is no reverse potential period. However, by providing a reverse potential period, sufficient displacement can be obtained even if the hysteresis curve changes.

The optimum value of the offset voltage ΔV for obtaining the maximum displacement differs between group 1 and group 2. It is thus preferable to adjust the value of the offset voltage ΔV in accordance with the required characteristics.

8. SECOND EXAMPLE AND THIRD EXAMPLE

Figure 10A:
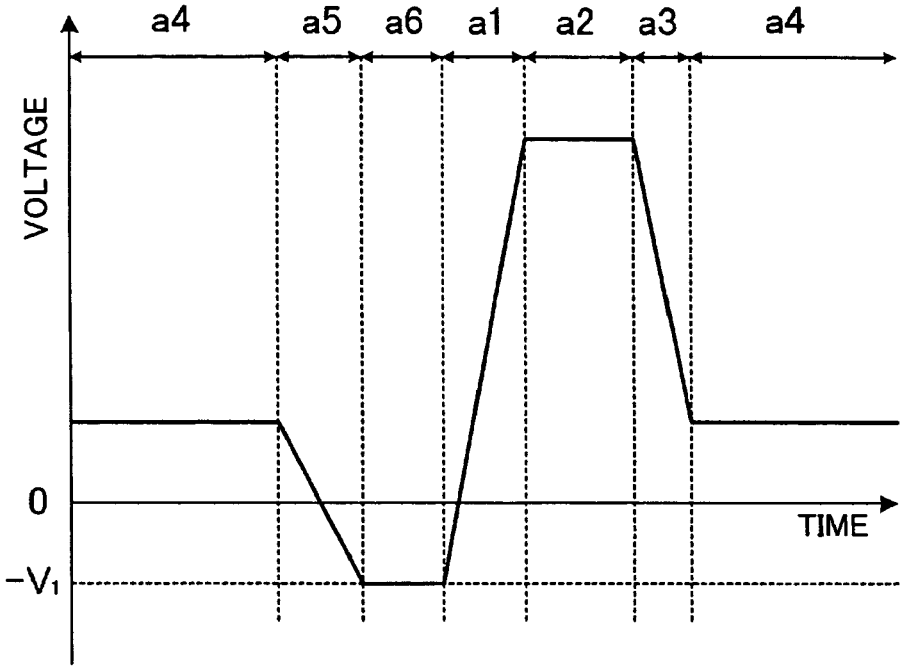
FIG. 10A is a waveform diagram showing an example of a voltage waveform applied to a piezoelectric element by liquid-ejecting apparatuses of a second example and a fourth example.
Figure 10B:
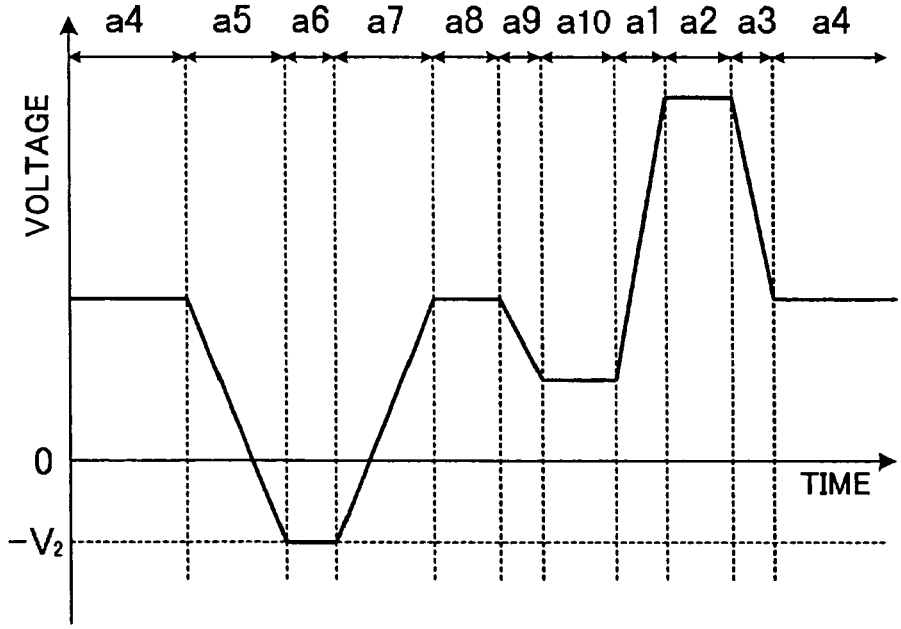
FIG. 10B is a waveform diagram showing an example of a voltage waveform applied to a piezoelectric element by liquid-ejecting apparatuses of a third example and a fifth example.

FIG. 10 are waveform diagrams showing examples of a voltage waveform applied to a piezoelectric element during a printing operation using liquid-ejecting apparatuses of other examples of the present invention. In particular, FIG. 10A shows one period's worth of the waveform for a second example, and FIG. 10B shows one period's worth of the waveform for a third example. When these waveforms are applied to the piezoelectric thin film, the waveform is applied at a frequency of 20 kHz to 50 kHz. This waveform is the waveform applied during the printing operation, and thus the waveform applied when printing is suspended, for example during head cleaning or an ink cartridge replacement sequence, may be different to this.

The driving waveform shown in FIG. 10A here comprises a potential maintaining period a4, a potential falling period a5, a potential maintaining period a6, a potential rising period a1, a potential maintaining period a2, and a potential falling period a3.

In the potential maintaining period a4, residual oscillation of the meniscus is stabilized. In the potential falling period a5 and the potential maintaining period a6, the meniscus is temporarily drawn into the nozzle, and moreover ink is newly drawn in from the ink tank, not shown in the drawings, thus preparing for ejection in the following potential rising period a1. In the potential rising period a1 and the potential maintaining period a2, a voltage is applied to the piezoelectric body to contract the pressure chamber, whereby ink is ejected from the nozzle. In the potential falling period a3, the pressure chamber is expanded, thus drawing the remaining ink that has not been ejected into the nozzle.

In particular, in the potential maintaining period a6, a voltage ($-V_1$) of having an opposite polarity to that in the potential maintaining period a2 when ink is ejected is applied to the piezoelectric body. By providing the driving waveform with such a reverse potential period in which a voltage such as that in the potential maintaining period a6 is applied, it becomes possible to exhibit the characteristics of the piezoelectric body to the full. To exhibit the characteristics of the piezoelectric body more effectively, it is preferable to provide one reverse potential period in which a voltage such as that in the potential maintaining period a6 is applied per one ink ejection.

In the potential maintaining period a2, the applied voltage is set such that the electric field strength in the piezoelectric body becomes at least $1.5\times10^7$ V/m. For example, the applied voltage in the potential maintaining period a2 is set to a value having a high absolute value of approximately 20 to 30V. In this case, if the thickness of the piezoelectric thin film is made to be 1 μm, then the electric field strength in the piezoelectric body during the potential maintaining period a2 is $2\times10^7$ to $3\times10^7$ V/m, which is as high as approximately ten times the coercive electric field $2\times10^6$ V/m of the piezoelectric body in the present example.

As with the first example, to exhibit the characteristics of the piezoelectric body effectively, it is preferable for the potential ($-V_1$) in the reverse potential period including the potential maintaining period a6 to be a potential such that the absolute value of the electric field strength in the piezoelectric body does not exceed the coercive electric field of the piezoelectric body. Moreover, it is preferable for the absolute value of the potential ($-V_1$) in the reverse potential period including the potential maintaining period a6 to be not more than the maximum value of the absolute value of the potential in a high potential period such as the potential maintaining period a2. For example, if the thickness of the piezoelectric body is made to be 1 μm, and the potential ($-V_1$) in the potential maintaining period a6 is made to be −2V, then the absolute value of the electric field strength in the piezoelectric body becomes $2\times10^6$ V/m.

In the potential rising period al in which a contraction operation of the pressure chamber is carried out, the potential rises from the negative potential following on from the potential maintaining period a6, and reaches the maximum potential at the potential maintaining period a2.

The driving waveform shown in FIG. 10B comprises parts like the above-mentioned a1 to a6, and in addition a potential rising period a7, a potential maintaining period a8, a potential falling period a9, and a potential maintaining period a10. The purpose of the potential rising period a7, the potential maintaining period a8 and the potential falling period a9 is to control the meniscus for the ink ejection that is carried out in the potential rising period a1 and the potential maintaining period a2; there is an effect of improving the ejection characteristics by giving the meniscus desired oscillation before the ink ejection.

As with the waveform of FIG. 10A, it is preferable for the voltage ($-V_2$) in the potential maintaining period a6 to be a voltage such that the absolute value of the electric field strength in the piezoelectric body does not exceed the coercive electric field, and is not more than the maximum value of the electric field during ink ejection.

9. FOURTH EXAMPLE AND FIFTH EXAMPLE

In the first to third examples described above, a description was given of advantages in the case that the electric field strength in the piezoelectric body during the reverse potential period does not exceed the coercive electric field, but this electric field strength may exceed the coercive electric field. Here, the cases that the potential ($-V_1$ or $-V_2$) in the potential maintaining period a6 out of the reverse potential period in the driving waveforms of FIG. 10A and FIG. 10B is made to be a potential such that the absolute value of the electric field strength in the piezoelectric body becomes greater than the coercive electric field of the piezoelectric body are taken to be a fourth example and a fifth example respectively. In such a case, it is preferable for the absolute value of the potential ($-V_1$ or $-V_2$) in the potential maintaining period a6 to be not more than the absolute value of the potential in the potential maintaining period a2. For example, if the thickness of the piezoelectric body is made to be 1 μm, and the potential ($-V_1$) in the potential maintaining period a6 is made to be −5V, then the absolute value of the electric field strength in the piezoelectric body becomes $5\times10^6$ V/m.

In this way, by making the potential in the potential maintaining period a6 be a potential that exhibits an electric field strength exceeding the coercive electric field, polarization remaining in the piezoelectric film during the driving waveform, i.e. at times other than times when printing is suspended, can be eliminated. If the piezoelectric body is made to be a thin film, then the residual polarization tends to drop relatively quickly, and hence even if polarization treatment is carried out as in Japanese Patent Laid-open No. 9-141866, the polarization drops if driving is not carried out for a while thereafter. In this case, a difference in polarization arises between elements having a driving history and elements not having a driving history, and hence variation arises between the elements. In the present examples, a voltage of the opposite polarity to the ejection voltage is applied during the driving waveform, and hence variation in the displacement between piezoelectric elements can be effectively suppressed even in the case that the printing operation is continued for a prolonged period.

Moreover, in the case of driving a liquid-ejecting head that uses piezoelectric thin films in particular, the strain in the piezoelectric thin films is high, becoming 0.3% or more. Furthermore, the elastic restoring force of the substrate cannot be made to be sufficient, and hence residual strain is prone to arising in the piezoelectric thin films. Eliminating the residual polarization is thus very important.

10. SIXTH EXAMPLE AND SEVENTH EXAMPLE

Figure 11:
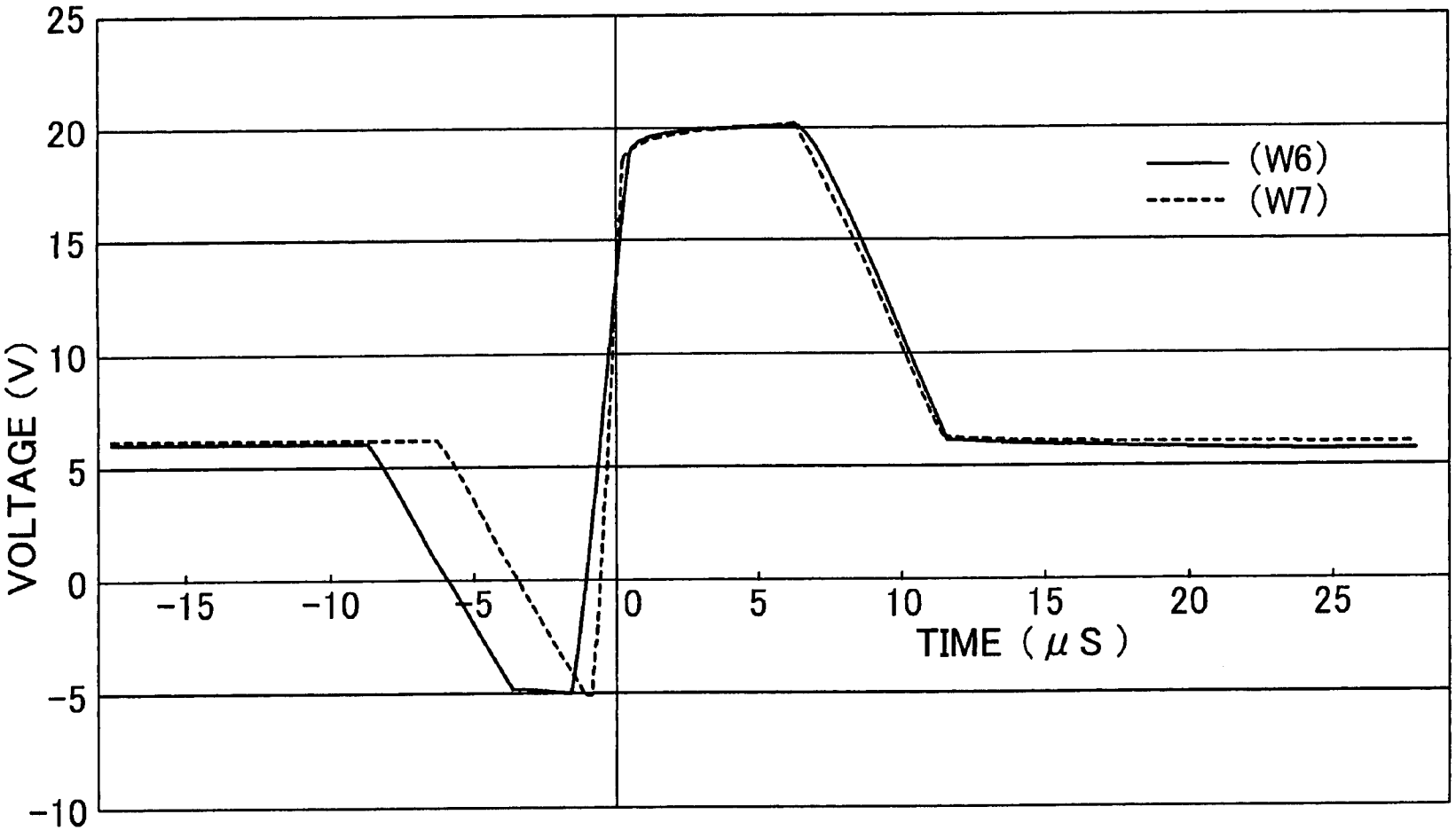
FIG. 11 is a graph showing driving waveforms according to a sixth example and a seventh example.
Figure 12:
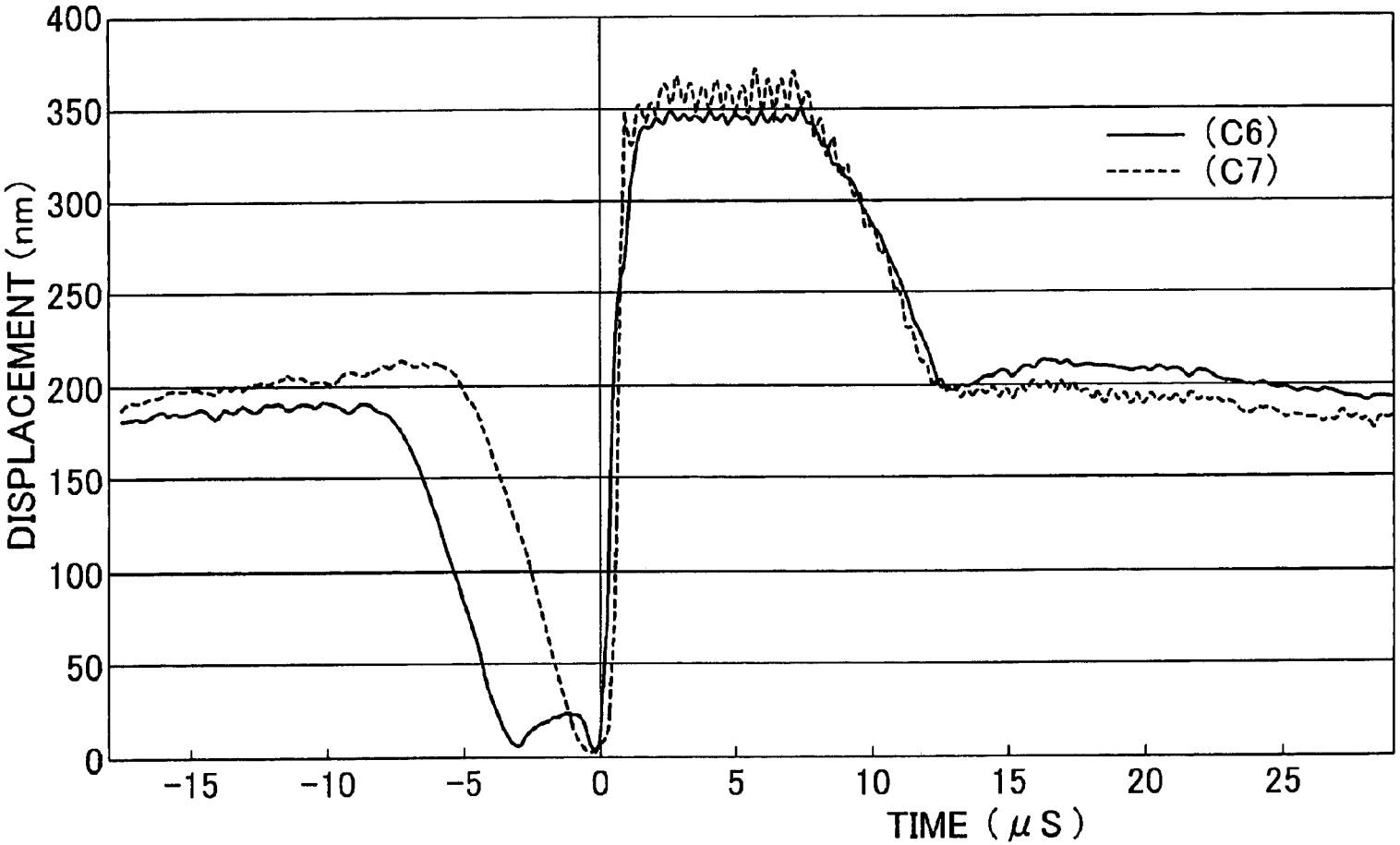
FIG. 12 is a graph showing the change over time in the displacement in the case of driving a piezoelectric thin film using the driving waveforms of the sixth example and the seventh example.

FIG. 11 shows driving waveforms of a sixth example and a seventh example, which are modifications of the fourth example. FIG. 12 shows the change over time in the displacement in the case of driving a piezoelectric thin film using these driving waveforms. The two driving waveforms shown in FIG. 11 have the common feature that the minimum value of the voltage applied during the reverse potential period is −5V, but the time period for which this voltage of −5V is applied differs. The waveform shown by the full line (W6) is for the sixth example, and the time period for which the voltage of −5V is applied is set to 2 μs. On the other hand, the waveform shown by the broken line (W7) is for the seventh example, and the time period for which the voltage of −5V is applied is set to 0.13 μs.

In the case that the coercive electric field of the piezoelectric thin film is made to be $2\times10^6$ V/m, and the thickness of the piezoelectric thin film is made to be 1.5 μm, if a voltage lower than −3V is applied to the piezoelectric thin film, then the electric field strength in the piezoelectric thin film exceeds the coercive electric field. The time period for which the electric field strength exceeds the coercive electric field, i.e. the time period for which a voltage lower than −3V is applied, is approximately 3 μs in the case of the waveform W6, and approximately 1.5 μs in the case of the waveform W7.

The curve C6 in FIG. 12 shows the change over time in the displacement in the case that the waveform W6 of FIG. 11 was applied. The difference between the maximum value and the minimum value of the displacement was 344 nm. As shown by this curve C6, if the coercive electric field is exceeded in the reverse potential period, then the direction of flexion inverts. That is, if the applied voltage is reduced, then the displacement drops until the coercive electric field is reached, but after the coercive electric field has been reached, the displacement rises even if the applied voltage is reduced. This shows that the polarization has inverted through the coercive electric field being exceeded. If the direction of flexion of the piezoelectric thin film inverts as in the curve C6, then the movement of the meniscus when the liquid-ejecting head is driven will become unstable, and hence it will become difficult to eject drops precisely.

On the other hand, the curve C7 in FIG. 12 shows the change over time in the displacement in the case that the waveform W7 of FIG. 11 was applied. It was found that upon making the time period for which the coercive electric field is exceeded during the reverse potential period be less than 2 μs, the direction of flexion does not reverse during the reverse potential period. Moreover, the difference between the maximum value and the minimum value of the displacement was 359 nm, and hence it was found that the displacement amount also becomes larger compared with the case of the curve C6.

Figure 13:
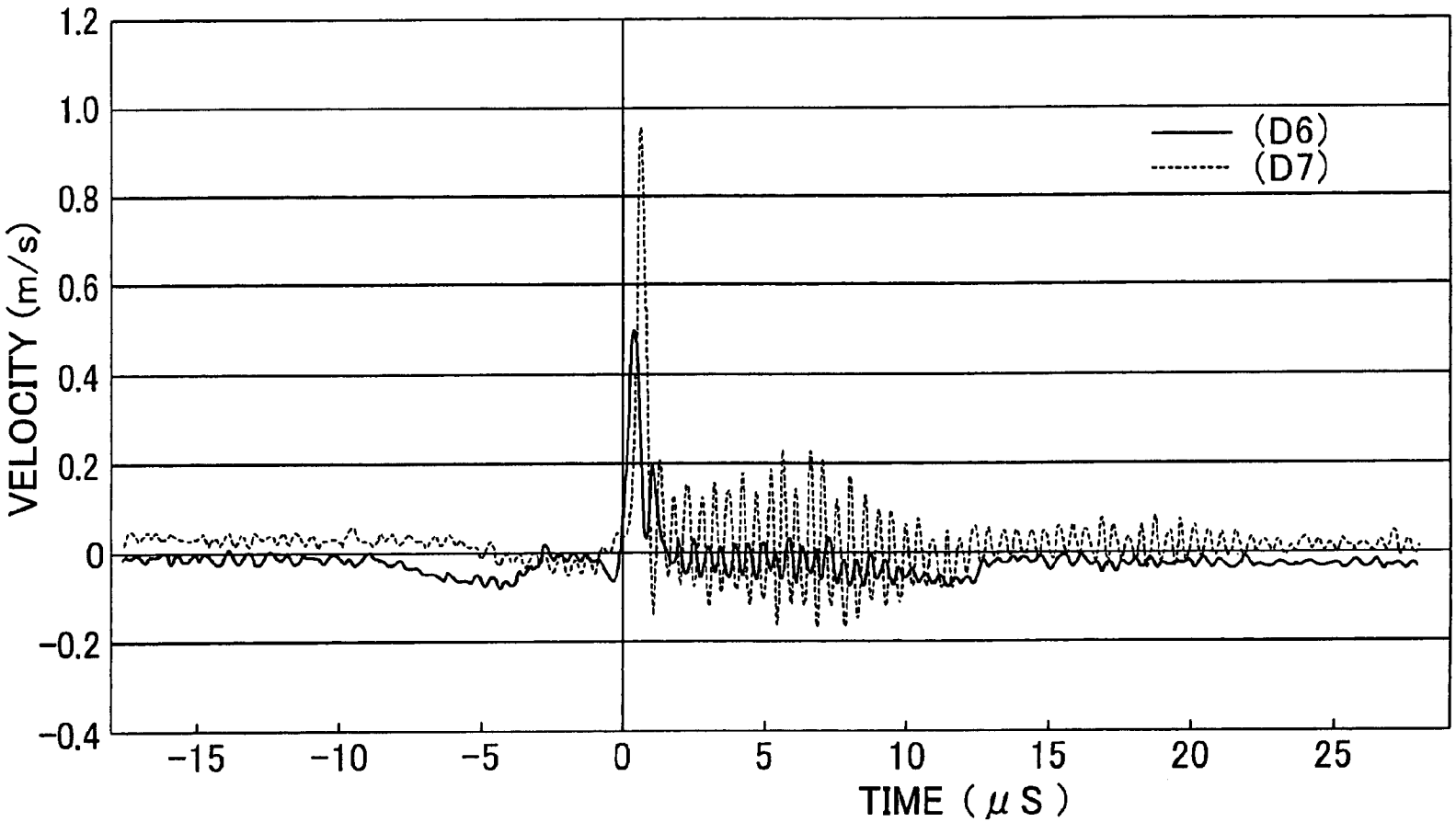
FIG. 13 is a graph showing the change over time in the displacement velocity of the diaphragm in the case of carrying out driving using the driving waveforms of the sixth example and the seventh example.

FIG. 13 is a graph showing the results of measurements of the change over time in the displacement velocity of the diaphragm in the cases that a liquid-ejecting head was driven using the driving waveforms described above. The displacement velocity D7 of the diaphragm during the contraction operation of the pressure chamber from the reverse potential period to the high potential period in the case of the seventh example increased to a maximum of around 1 m/s, whereas the displacement velocity D6 of the diaphragm during the contraction operation in the case of the sixth example had a maximum of 0.5 m/sec, which is approximately half of that for the seventh example. It is apparent from this that the displacement velocity of the diaphragm can be increased by using the driving waveform of the seventh example.

As described above, with the driving method of the seventh example, the pressure chamber 21 is expanded by changing the applied voltage in the reverse potential period as far as a potential having an absolute value higher than the potential at which a coercive electric field arises in the piezoelectric thin-film layer 41. Moreover, it has been made to be such that after contraction of the pressure chamber 21 has started with the coercive electric field, a high potential period is moved into while inversion to expansion has still not occurred, and the pressure chamber is further contracted, thus ejecting liquid. As a result, the displacement amount and the displacement velocity of the diaphragm 30 can be increased. That is, with the driving method of the present invention, the displacement of the diaphragm 30 due to the coercive electric field is made to act as displacement for during ink ejection, and hence the displacement amount and the displacement velocity of the diaphragm 30 during contraction of the pressure chamber 21 can be substantially increased.

Moreover, with the present example, if the time period for which the coercive electric field is exceeded during the reverse potential period is set to be less than 2 μs, then the displacement amount of the diaphragm 30 due to the coercive electric field can be made to act as displacement for during ink ejection. Moreover, if the time period between starting and finishing to contract of the pressure chamber 21 is set to be less than 2 μs, then the transition from the start of the contraction in the reverse potential period to the end of the contraction in the high potential period becomes smooth, and hence the displacement amount of the diaphragm 30 can be increased effectively. As a result, there is also an advantage that the ink ejection speed can be made faster.

11. EIGHTH EXAMPLE AND NINTH EXAMPLE

FIG. 14 are graphs showing an example of the driving signal and the displacement of a piezoelectric element according to an eighth example of the present invention.

Figure 14A:
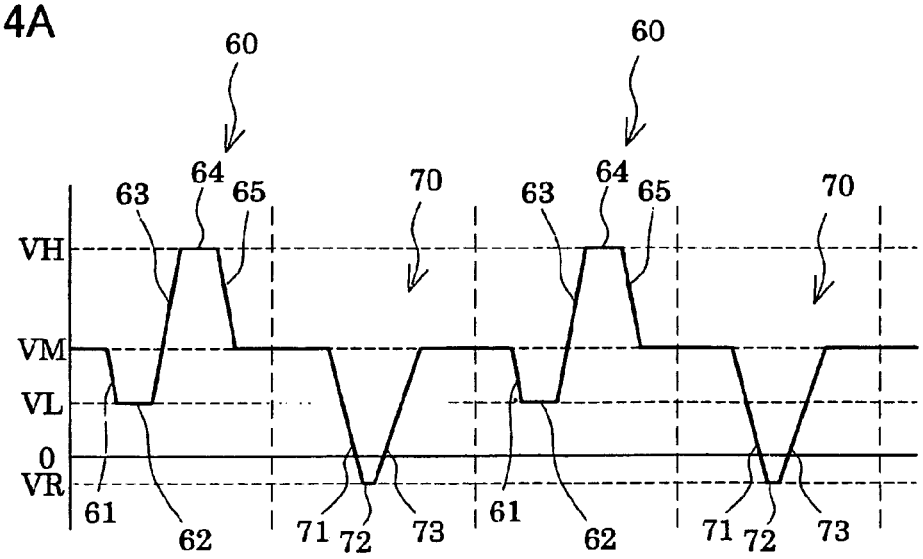
FIGS. 14A-14B are graphs showing an example of the driving signal and the displacement of a piezoelectric element according to an eighth example of the present invention.

In the eighth example, as shown in FIG. 14A, the basic driving signal (COM) applied to the piezoelectric element 40 has a high potential period 60 and a reverse potential period 70. An ink drop is ejected through the voltage of the high potential period 60 being outputted to the piezoelectric element 40 in accordance with printing data. After that, the voltage of the reverse potential period 70 is outputted to the piezoelectric element 40. In the present example, one high potential period 60 and one reverse potential period 70 are outputted alternately.

Here, the ink jet recording head 1 in the present example is a so-called 'draw fire' type ink jet recording head. The high potential period 60 is constituted from the following steps: a first expansion step 61 of reducing the potential from a state in which a medium potential VM is maintained down to a potential VL, thus expanding the pressure chamber 21; a first holding step 62 of maintaining the minimum potential VL for a certain time period; a contraction step 63 of increasing the potential from the minimum potential VL to a maximum potential VH, thus contracting the pressure chamber 21 and hence ejecting an ink drop; a second holding step 64 of maintaining the maximum potential VH for a certain time period; and a second expansion step 65 of reducing the potential from the maximum potential VH to the medium potential VM.

The reverse potential period 70, on the other hand, is constituted from the following steps: a reducing step 71 of reducing the potential from the medium potential VM to a prescribed potential VR that is zero or below; a holding step 72 of maintaining the prescribed potential VR for a certain time period; and an increasing step 73 of increasing the potential from the prescribed potential VR to the medium potential VM.

When the piezoelectric element 40 is driven using a high potential period 60 as described above, as shown in FIG. 14B, the piezoelectric element 40 deforms from a medium displacement DM to a minimum displacement DL during the first expansion step 61, whereby the meniscus in the nozzle 11 is drawn in toward the pressure chamber 21 side. Next, the contraction step 63 is carried out via the first holding step 62, and hence the piezoelectric element 40 deforms as far as a maximum displacement DH, whereby an ink drop is ejected. Specifically, the contraction step 63 is carried out at a timing when the meniscus is pushed out toward the nozzle 11 side due to the oscillation caused by the first expansion step 61. As a result, the oscillation of the meniscus due to the first expansion step 61 and the oscillation of the meniscus due to the contraction step 63 are superimposed, and hence the ink drop is ejected from the nozzle 11 at a relatively high speed. After that, the displacement of the piezoelectric element 40 is returned to the original displacement through the second expansion step 65.

Figure 14B:
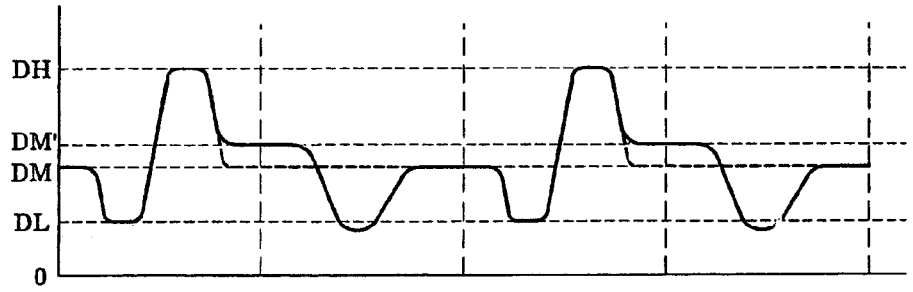

Here, in the second expansion step 65, by reducing the potential from the maximum potential VH to the medium potential VM, an attempt is made to return the displacement of the piezoelectric element 40 from the maximum displacement DH to the medium displacement DM as shown by the dashed line in FIG. 14B. However, in actual fact the strain in the piezoelectric element 40 does not return as far as the medium displacement DM, but rather the displacement of the piezoelectric element 40 is maintained at a medium displacement DM'.

In the present example, it has thus been made to be such that the potential is returned to the medium potential VM via the reverse potential period 70 after the high potential period 60, whereby the displacement of the piezoelectric element 40 is returned to the prescribed medium displacement DM.

Specifically, after the ink drop ejection, when the potential is reduced to zero or below, for example to −5V, through the reducing step 71 of the reverse potential period 70, then the displacement of the piezoelectric element 40 first changes to a displacement below the medium displacement DM. After that, when the potential is returned to the medium potential VM through the increasing step 73 via the holding step 72, then the displacement of the piezoelectric element 40 returns to the medium displacement DM. As a result, the displacement amount of the piezoelectric element 40 due to the following high potential period 60 is stabilized, and hence an ink drop of the desired size can be ejected.

Here, the reducing step 71 in the reverse potential period 70 should be such that the potential can be reduced down to zero or below, and there is no particular limitation on the gradient of the potential, but it is preferable to make the gradient in the increasing step 73 relatively low to the extent that there is no effect on the oscillation of the meniscus. This is because with the ink jet recording head 1 of the present example, when the piezoelectric element 40 is driven through the increasing step 73, the pressure chamber 21 contracts and thus an oscillation arises in the meniscus in a direction of ink drop ejection, and hence if the gradient in the increasing step 73 is made large then there will be a risk of an ink drop being accidentally ejected.

Moreover, if the gradient in the increasing step 73 is made to be too low, then it will be necessary to make the ink drop ejection interval long and thus high-speed driving will no longer be possible, and hence it is preferable to make the gradient in the increasing step 73 be as large as possible but such that there is no affect on the oscillation of the meniscus.

In this way, in the present example, it has been made to be such that a reverse potential period 70 is provided between each of the high potential periods 60, and hence when the voltage of the high potential period 60 is outputted to the piezoelectric element 40, the displacement of the piezoelectric element 40 is always maintained at the medium displacement DM. The displacement amount of the piezoelectric element 40 due to each high potential period 60 is thus substantially increased. Moreover, even if the maximum potential VH in the high potential period 60 is reduced, the current displacement amount is maintained, and moreover the durability can be improved. Furthermore, the displacement amount of the piezoelectric element 40 due to each high potential period 60 is stabilized, and hence printing can be carried out always with the desired dot size even in the case of driving at a relatively high speed.

Figure 15:
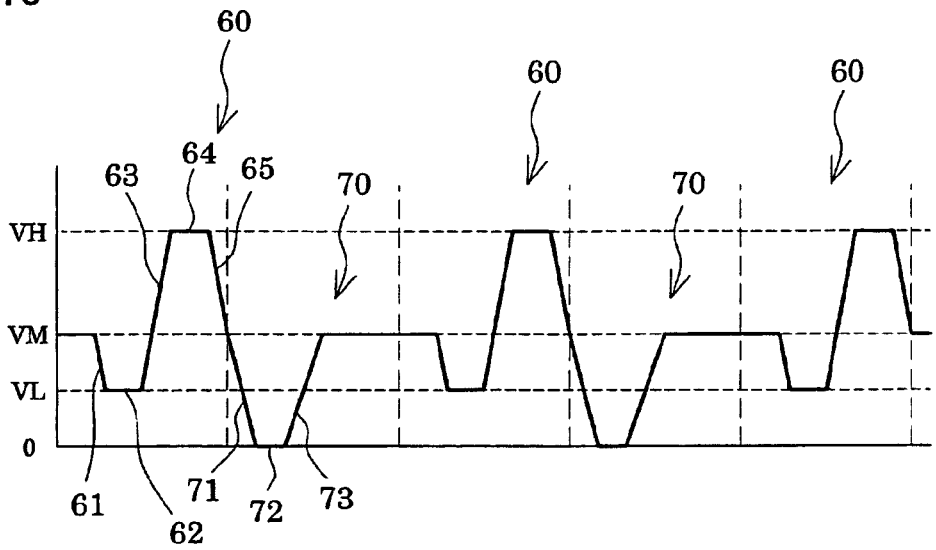
FIG. 15 is a graph showing an example of the driving signal according to a ninth example of the present invention.

In the present example, it was made to be such that after ejection of an ink drop through a high potential period 60, there is a prescribed time interval before the voltage of the reverse potential period 70 is outputted, but there is no limitation to this. For example, as with the driving waveform of a ninth example shown in FIG. 15, the voltage of the reverse potential period 70 may be outputted immediately after outputting the voltage of the high potential period 60, i.e. the potential may be changed continuously from the maximum potential in the high potential period to the potential of the reverse potential period. In either case, the potential is temporarily reduced down to zero or below, whereby the strain in the piezoelectric element 40 can reliably be returned to a prescribed medium displacement. Moreover, if the time interval between the high potential period 60 and the reverse potential period 70 is made to be short, then printing at relatively high speed can be carried out.

Moreover, in the eighth example and the ninth example, it was made to be such that the gradient in the increasing step 73 of the reverse potential period 70 is made to be low, whereby accidental ejection of an ink drop while returning the potential from the minimum potential VR of the reverse potential period 70 to the medium potential VM can be prevented, but the method of preventing accidental ejection of an ink drop is not limited to this. For example, accidental ejection of an ink drop can also be prevented by carrying out the increasing step 73 in accordance with the period of oscillation of the meniscus. That is, the increasing step 73 is carried out at a timing when the oscillation of the meniscus that has arisen due to the reducing step 71 of the reverse potential period 70 is at a stage at which the meniscus is being drawn in toward the pressure chamber 21 side. As a result, the oscillation of the meniscus arising due to the increasing step 73 and the oscillation of the meniscus that has arisen due to the reducing step 71 cancel one another out, and hence accidental ejection of an ink drop can be prevented.

In this way, accidental ejection of an ink drop can be prevented even if the gradient in the increasing step 73 of the reverse potential period 70 is made to be relatively high, and hence yet faster driving can be realized.

12. TENTH EXAMPLE

FIG. 16 are graphs showing an example of the driving signal and the displacement of a piezoelectric element according to a tenth example of the present invention.

Figure 16A:
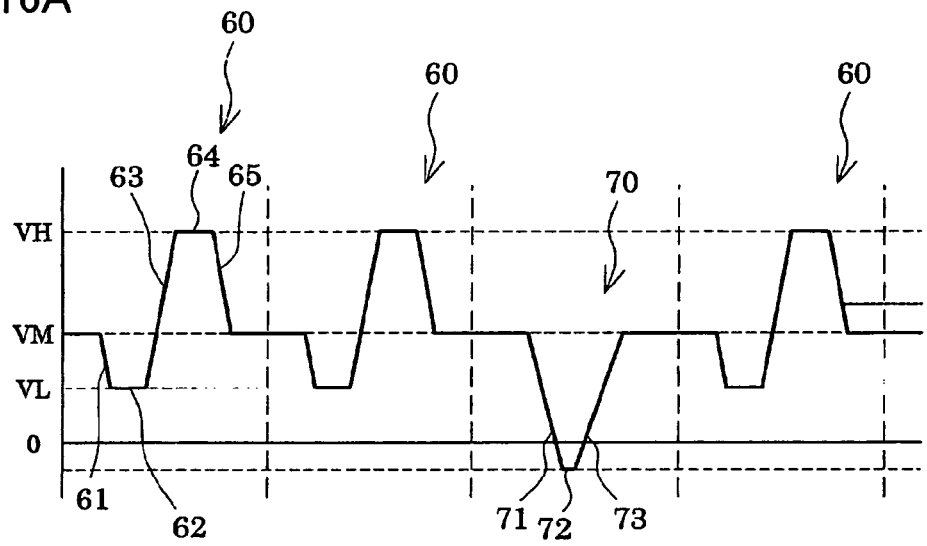
FIGS. 16A-16B are graphs showing an example of the driving signal and the displacement of a piezoelectric element according to a tenth example of the present invention.

In the present example, as shown in FIG. 16A, the voltage of the reverse potential period 70 is selectively outputted between high potential periods 60, whereby two types of ink drop of different sizes to one another can be ejected.

Figure 16B:
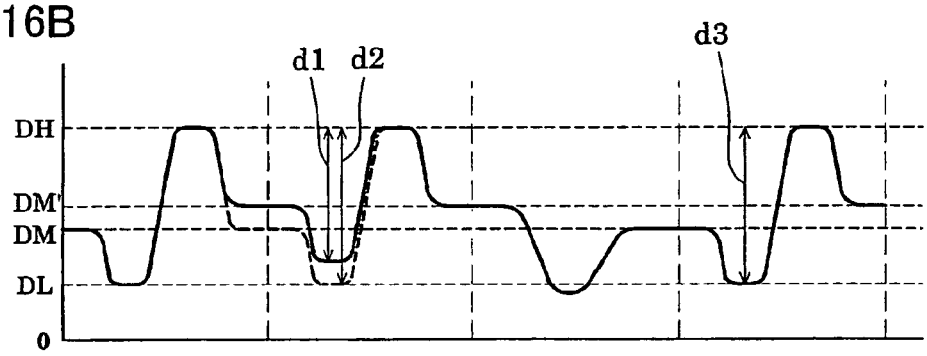

Specifically, in the case that the voltage of the high potential period 60 is continuously outputted with no intervening reverse potential period 70, the displacement of the piezoelectric element 40 after each high potential period 60 has been passed through becomes the medium displacement DM' as shown in FIG. 16B. As a result, the actual displacement amount d1 of the piezoelectric element 40 due to the contraction step 63 of the high potential period 60 becomes smaller than the displacement amount d2 in the case that the medium displacement DM is passed through, and hence the size of the ink drop ejected is smaller than the size in the case that the medium displacement DM is passed through (the normal dot size).

Note, however, that the medium displacement DM' after each high potential period 60 is an approximately constant displacement. That is, in the case that the voltage of the high potential period 60 is outputted in succession to the piezoelectric element 40, the size of the ink drops ejected becomes smaller than the normal dot size, and yet the size of the ink drops is approximately constant.

On the other hand, in the case that the voltage of a reverse potential period 70 is outputted between high potential periods 60, the actual displacement amount d3 of the piezoelectric element 40 due to the contraction step 63 of the high potential period 60 after the reverse potential period 70 is approximately the same as the displacement amount d2 in the case that the medium displacement DM is passed through, and hence an ink drop of the normal dot size is ejected.

Consequently, by selectively outputting the reverse potential period 70, two types of ink drop of different sizes to one another can easily be ejected.

For example, by outputting high potential periods 60 and reverse potential periods 70 to the piezoelectric element 40, ink drops of the normal dot size can be ejected. Moreover, by continuously outputting high potential periods 60 with no intervening reverse potential periods 70, ink drops of a small dot size can be ejected.

In this way, dot gradation control can be carried out merely by controlling the driving signal, and hence high-quality printing can be realized relatively easily.

In addition to an ink-ejecting head used in an ink jet recording apparatus, the liquid-ejecting head driving method and liquid-ejecting apparatus of the present invention can also be applied to heads that jet out various liquids, for example heads that eject a liquid containing a colorant used in the manufacture of color filters for liquid crystal displays or the like, heads that eject a liquid containing an electrode material used in electrode formation for organic EL displays, FEDs (field emission displays) or the like, and heads that eject a liquid containing a biological organic substance used in biochip manufacture.

INDUSTRIAL APPLICABILITY

According to the liquid-ejecting apparatus and the driving method of the present invention, a liquid-ejecting apparatus and a driving method can be provided according to which targeted good characteristics can be obtained, and moreover the scope for material selection can be broadened.

We claim:

1. A liquid-ejecting apparatus comprising:

a piezoelectric body; and a pressure chamber that changes volume and thus ejects liquid through application of voltage to the piezoelectric body, wherein a driving waveform applied to said piezoelectric body during the liquid ejecting operation based on signals output from a control unit, comprises a high potential period in which a voltage exhibiting an electric field strength exceeding the coercive electric field of said piezoelectric body is applied, and a reverse potential period in which a voltage such that the potential becomes of the opposite polarity to the polarity in said high potential period or the potential becomes zero is applied, wherein the voltage applied in said reverse potential period is a voltage exhibiting an electric field strength of at least the coercive electric field of said piezoelectric body, and wherein the time period between when the absolute value of the voltage applied in said reverse potential period starts to drop from a maximum value and when the absolute value of the voltage applied in said high potential period reaches approximately a maximum is not more than 2 μs.

2. The liquid-ejecting apparatus according to claim 1, wherein the voltage is applied to a piezoelectric thin film.

3. The liquid-ejecting apparatus according to claim 1, wherein a voltage exhibiting an electric field strength of at least $1.5\times10^7$ V/m is applied in said high potential period.

4. The liquid-ejecting apparatus according to claim 1, wherein said driving waveform has one of said reverse potential period per one of said high potential period.

5. The liquid-ejecting apparatus according to claim 1, wherein, out of said driving waveform applied during the liquid ejecting operation, a portion corresponding to during a contraction operation of said pressure chamber contains at least part of said high potential period, and at least part of said reverse potential period.

6. The liquid-ejecting apparatus according to claim 1, wherein the strain in the piezoelectric body during liquid ejection by said liquid-ejecting apparatus is at least 0.3%.

7. A liquid-ejecting apparatus comprising:

a piezoelectric body; and a pressure chamber that changes volume and thus ejects liquid through application of voltage to the piezoelectric body, wherein a driving waveform applied to said piezoelectric body during the liquid ejecting operation based on signals output from a control unit, comprises a high potential period in which a voltage exhibiting an electric field strength exceeding the coercive electric field of said piezoelectric body is applied, and a reverse potential period in which a voltage such that the potential becomes of the opposite polarity to the polarity in said high potential period or the potential becomes zero is applied, and wherein the voltage is applied at a frequency of at least 20 kHz.

* * * * *